US011284198B2

(12) United States Patent
Tabata

(10) Patent No.: US 11,284,198 B2
(45) Date of Patent: Mar. 22, 2022

(54) SPEAKER UNIT

(71) Applicant: Foster Electric Company, Limited, Tokyo (JP)

(72) Inventor: Takayuki Tabata, Tokyo (JP)

(73) Assignee: Foster Electric Company, Limited, Tokyo (JP)

( * ) Notice: Subject to any disclaimer, the term of this patent is extended or adjusted under 35 U.S.C. 154(b) by 0 days.

(21) Appl. No.: 16/755,622

(22) PCT Filed: Aug. 22, 2018

(86) PCT No.: PCT/JP2018/030983
§ 371 (c)(1),
(2) Date: Apr. 13, 2020

(87) PCT Pub. No.: WO2019/073697
PCT Pub. Date: Apr. 18, 2019

(65) Prior Publication Data

US 2020/0336838 A1 Oct. 22, 2020

(30) Foreign Application Priority Data

Oct. 13, 2017 (JP) ..... JP2017-199021

(51) Int. Cl.
*H04R 9/02* (2006.01)
*H04R 7/02* (2006.01)

(52) U.S. Cl.
CPC ..... *H04R 9/025* (2013.01); *H04R 7/02* (2013.01)

(58) Field of Classification Search
CPC ..... H04R 9/025; H04R 7/02
(Continued)

(56) References Cited

U.S. PATENT DOCUMENTS 5,143,169 A * 9/1992 Ziegenberg ..... H04R 7/02 181/144
5,933,512 A * 8/1999 Tamura ..... H04R 9/06 381/424

(Continued)

FOREIGN PATENT DOCUMENTS

CN 1179692 4/1998
CN 1389083 A 1/2003

(Continued)

OTHER PUBLICATIONS

European Patent Office; European Search Report dated Nov. 5, 2020; entire document.

(Continued)

*Primary Examiner* — Sean H Nguyen
(74) *Attorney, Agent, or Firm* — Allen, Dyer, Doppelt & Gilchrist, P.A.

(57) ABSTRACT

A speaker unit, which can be made thin, includes: a magnetic circuit 61 having a space serving as a magnetic gap G formed inside a cylindrical portion 69; a voice coil 85 arranged in the magnetic gap G; and a diaphragm 51 having a center hole 51*a* that penetrates a center of the diaphragm, an outer peripheral portion 51*b* supported on a frame 53, and an inner peripheral portion 51*c* whose inner peripheral surface is connected to the voice coil 85. The cylindrical portion 69 of the magnetic circuit 61 includes a standing wall 69*c* formed along a vibration direction A of the diaphragm 51, and a slit 69*a*. The inner peripheral portion 51*c* of the diaphragm 51 includes an insert hole (a standing wall receiving portion) 57 in which the standing wall 69*c* is inserted, and an insert portion 59 which is inserted in the slit 69*a*.

8 Claims, 11 Drawing Sheets

(58) Field of Classification Search
USPC ..... 381/412
See application file for complete search history.

(56) References Cited

U.S. PATENT DOCUMENTS

| | | | | |
|---|---|---|---|---|
| 2002/0061117 | A1 | 8/2002 | Takewa | |
| 2003/0053651 | A1* | 3/2003 | Koura | H04R 9/04 381/405 |
| 2004/0136561 | A1 | 7/2004 | Want | |
| 2005/0111690 | A1 | 5/2005 | Onuma et al. | |
| 2005/0141746 | A1* | 6/2005 | Kobayashi | H04R 9/041 381/424 |
| 2005/0201588 | A1* | 9/2005 | Funahashi | H04R 7/26 381/423 |
| 2006/0215871 | A1* | 9/2006 | Funahashi | H04R 9/043 381/396 |
| 2006/0245615 | A1* | 11/2006 | Funahashi | H04R 7/26 381/398 |
| 2014/0044301 | A1 | 2/2014 | Zhang et al. | |
| 2015/0358705 | A1 | 12/2015 | Chen et al. | |

FOREIGN PATENT DOCUMENTS

| | | |
|---|---|---|
| CN | 200973173 | 11/2007 |
| CN | 200997173 | 11/2007 |
| CN | 101626535 | 1/2010 |
| CN | 1016265335 | 1/2010 |
| CN | 102932716 | 2/2013 |
| CN | 1 03581806 A | 2/2014 |
| CN | 104822115 | 8/2015 |
| EP | 0762802 | 3/1997 |
| EP | 0809416 | 11/1997 |
| EP | 1207719 | 5/2002 |
| JP | 58056600 | 4/1983 |
| JP | 61396 | 1/1986 |
| JP | 1225299 | 9/1989 |
| JP | 7154896 | 6/1995 |
| JP | 200278082 | 3/2002 |
| JP | 2002159091 | 5/2002 |
| JP | 20114308 | 1/2011 |
| JP | 2011010913 | 1/2011 |
| WO | 2017149984 | 9/2017 |

OTHER PUBLICATIONS

European Patent Office; European Search Report dated Nov. 5, 2020 for PCT/JP2018/030983; entire document.
Office Action dated Jul. 26, 2021 for Chinese Patent Application No. 201880065429.5; entire document.

* cited by examiner

SPEAKER UNIT

TECHNICAL FIELD

The present invention relates to a speaker unit, particularly to a thin speaker unit.

BACKGROUND ART

In recent years, there has been an increasing demand for a speaker unit to be made thinner. A speaker unit having the structure shown in FIGS. 10 and 11 is an example of a speaker unit that is made thin. FIG. 10 is a cross-sectional view of the speaker unit taken along line B-O-C in FIG. 11, and FIG. 11 is a top view of the speaker unit from which a dust cap shown in FIG. 10 is removed.

In FIG. 10, a magnetic circuit 8 includes a bottomed cylindrical yoke 4 one end face of which is open, a disc-like magnet 7 provided on an inner bottom surface of the yoke 4, and a disc-shaped center pole 6 stacked on the magnet 7. A cylindrical portion of the yoke 4 has six slits 5 which are arranged at a pitch of 60 degrees along the circumferential direction and extend from an end of the open face toward the bottom. A gap is formed between outer peripheral surfaces of the magnet 7 and the center pole 6 and an inner peripheral surface of the cylindrical portion of the yoke 4, and a gap between the outer peripheral surface of the center pole 6 and the inner peripheral surface of the yoke 4 serves as a magnetic gap.

A voice coil 3 arranged in the magnetic gap includes a cylindrical bobbin 1, and a coil 2 wound around a peripheral surface of the bobbin 1.

A double ring 12 includes an outer ring 10 facing an outer peripheral surface of the yoke 4 with a gap interposed therebetween, an inner ring 9 connected to the bobbin 1 of the voice coil 3, and six joints 11 connecting the outer ring 10 and the inner ring 9. The joints 11 are arranged to correspond to the slits 5 of the magnetic circuit 8. Thus, the voice coil 3 and the double ring 12 are integrated with each other.

An inner peripheral portion of a diaphragm 13 is connected to a lower portion of the outer ring 10 of the double ring 12. An outer peripheral portion of the diaphragm 13 is attached to a frame 16 via an edge portion 15.

Thus, the double ring 12 and the voice coil 3 are movable in a non-contact manner with the yoke 4.

A dust cap 17 that covers the bobbin 1 and the double ring 12 is arranged at a center portion of the diaphragm 13.

How the configuration described above operates will be described below.

A magnetic field is generated in the magnetic gap of the magnetic circuit 8. When a voice signal is supplied to the coil 2 of the voice coil 3 arranged in the magnetic gap, a driving force (propulsion force) is generated in the voice coil 3 due to the Fleming's left-hand rule, which vibrates the diaphragm 13, and sound is emitted.

According to the above-described configuration, an inner peripheral surface of the diaphragm 13 is connected to the lower portion of the outer ring 10 of the double ring 12. This can make the speaker unit thin.

CITATION LIST

Patent Documents

Patent Document 1: Japanese Unexamined Patent Publication No. 2002-78082

SUMMARY OF THE INVENTION

Technical Problem

Although the speaker unit configured as shown in FIGS. 10 and 11 can be made thin, the double ring 12 is still necessary, and the following problems arise.

(1) The number of components increases, and the cost increases.

(2) Heat generated in the coil 2 restricts the material of the double ring 12 to a heat-resistant metal or the like, which is noneconomic.

(3) A portion driven to vibrate by the voice coil 3 includes two members, namely, the diaphragm 13 and the double ring 12, which increases the mass. This requires the strong magnetic circuit 8 and increases the cost.

(4) The vibrating portion with the increased mass delays the response of the diaphragm 13, which deteriorates sound quality.

The present invention has been achieved in view of the above problems, and an object of the present invention is to provide a speaker unit which is low in cost, good in sound quality, and can be made thin.

Solution to the Problem

A speaker unit according to the present invention that achieves the object includes:

a magnetic circuit having an outer cylindrical portion and an annular space formed inside the outer cylindrical portion, the annular space serving as a magnetic gap;

a voice coil arranged in the magnetic gap; and a diaphragm having a center hole that penetrates a center of the diaphragm, an outer peripheral portion supported on a frame, and an inner peripheral portion whose inner peripheral surface is connected to the voice coil, wherein the outer cylindrical portion of the magnetic circuit includes a standing wall formed along a vibration direction of the diaphragm, and a slit, and the inner peripheral portion of the diaphragm includes a standing wall receiving portion in which the standing wall is inserted, and an insert portion which is inserted in the slit.

Other features of the present invention will become more apparent from the following embodiments of the invention and the accompanying drawings.

Advantages of the Invention

The speaker unit of claim 1 of the present invention can provide the following advantages.

(1) The diaphragm includes the standing wall receiving portion in which the standing wall of the outer cylindrical portion of the magnetic circuit is inserted, and the insert portion which is inserted in the slit of the outer cylindrical portion. This allows the diaphragm and the voice coil to be connected together below a tip end of the magnetic circuit. Therefore, the speaker unit can be thinned down without reducing the height of the diaphragm in the vibration direction. Further, the diaphragm can reliably have a sufficient height difference (overall height), which can keep the rigidity of the entire diaphragm from decreasing.

(2) Connecting the inner peripheral surface of the center hole of the diaphragm to the lower portion of the voice coil makes it possible to reliably reduce the thickness of the speaker unit without reducing the height (overall height) of the diaphragm in the vibration direction.

(3) The double ring, which has been required for thinning the speaker unit, is no longer necessary. This can reduce the number of parts, and the cost as well.

(4) What is driven to vibrate by the voice coil is only the diaphragm. Thus, the mass is reduced, and a strong magnetic circuit is no longer necessary, thereby reducing the cost.

(5) Reduced mass of the vibrating portion improves the response of the diaphragm, and the sound quality as well.

Other advantages of the present invention will become more apparent from the following embodiments of the invention and the accompanying drawings.

DESCRIPTION OF EMBODIMENTS

First Embodiment

Figure 1:
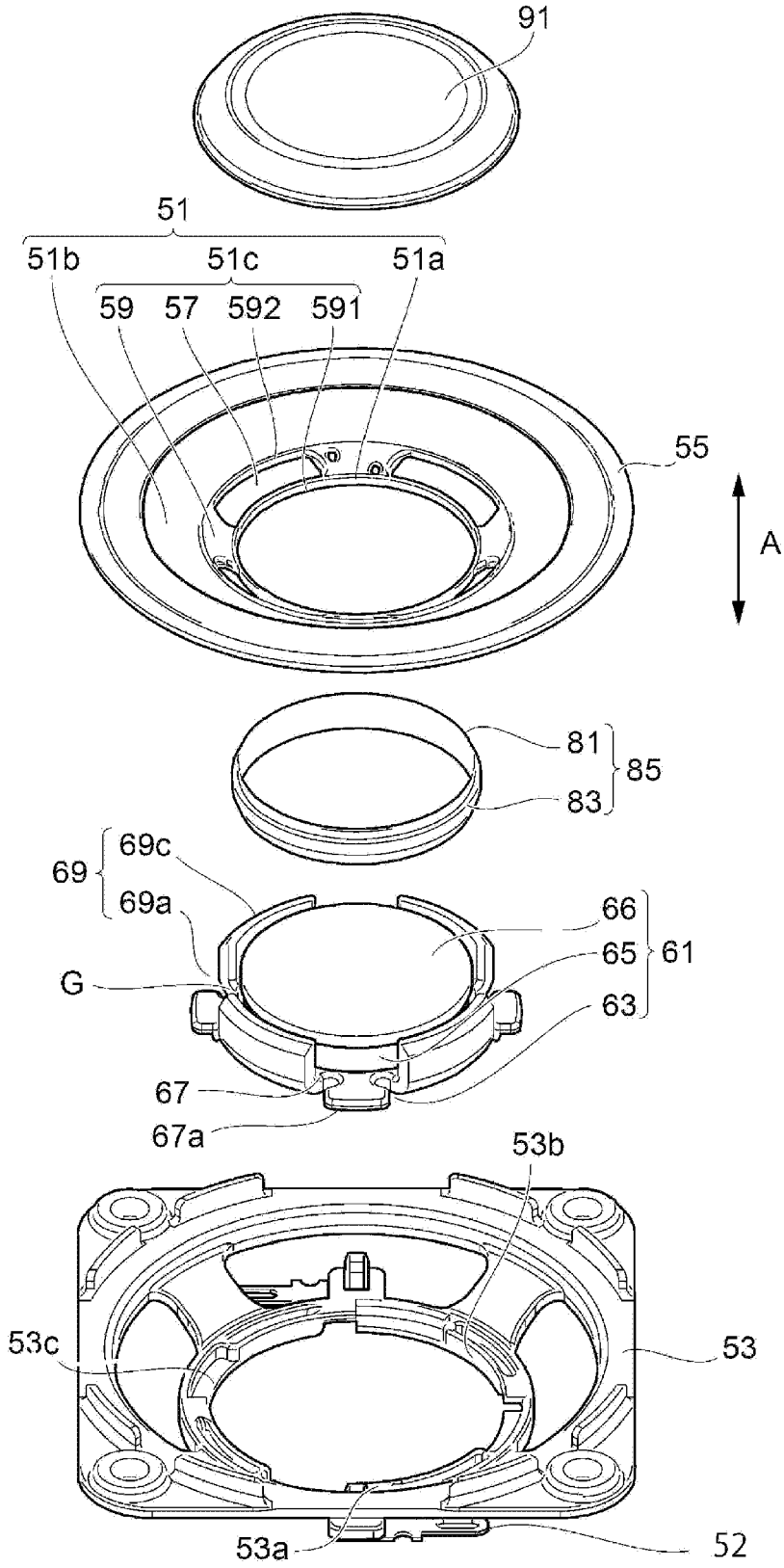
FIG. 1 is an exploded perspective view illustrating a speaker unit according to a first embodiment of the present invention.
Figure 2:
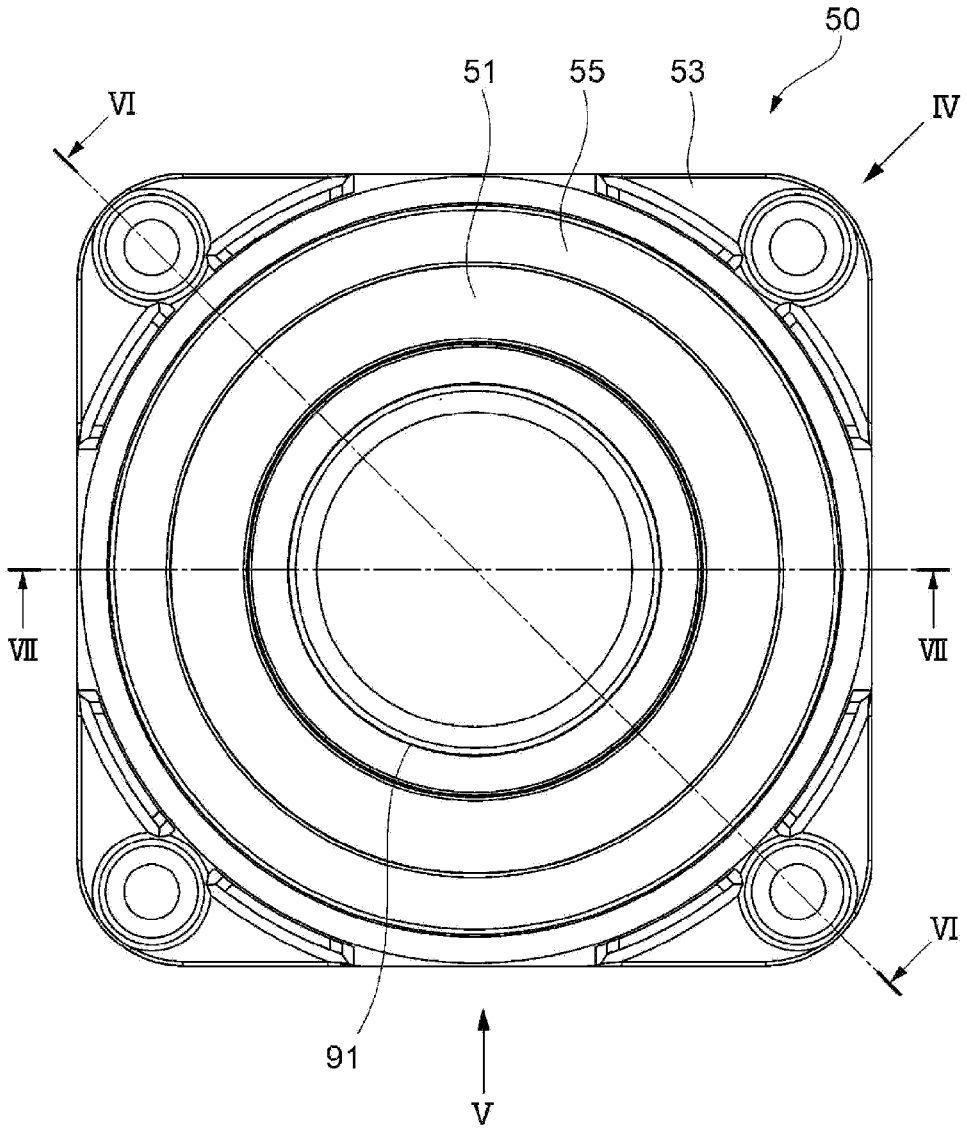
FIG. 2 is a front view illustrating the components shown in FIG. 1 in an assembled state.
Figure 3:
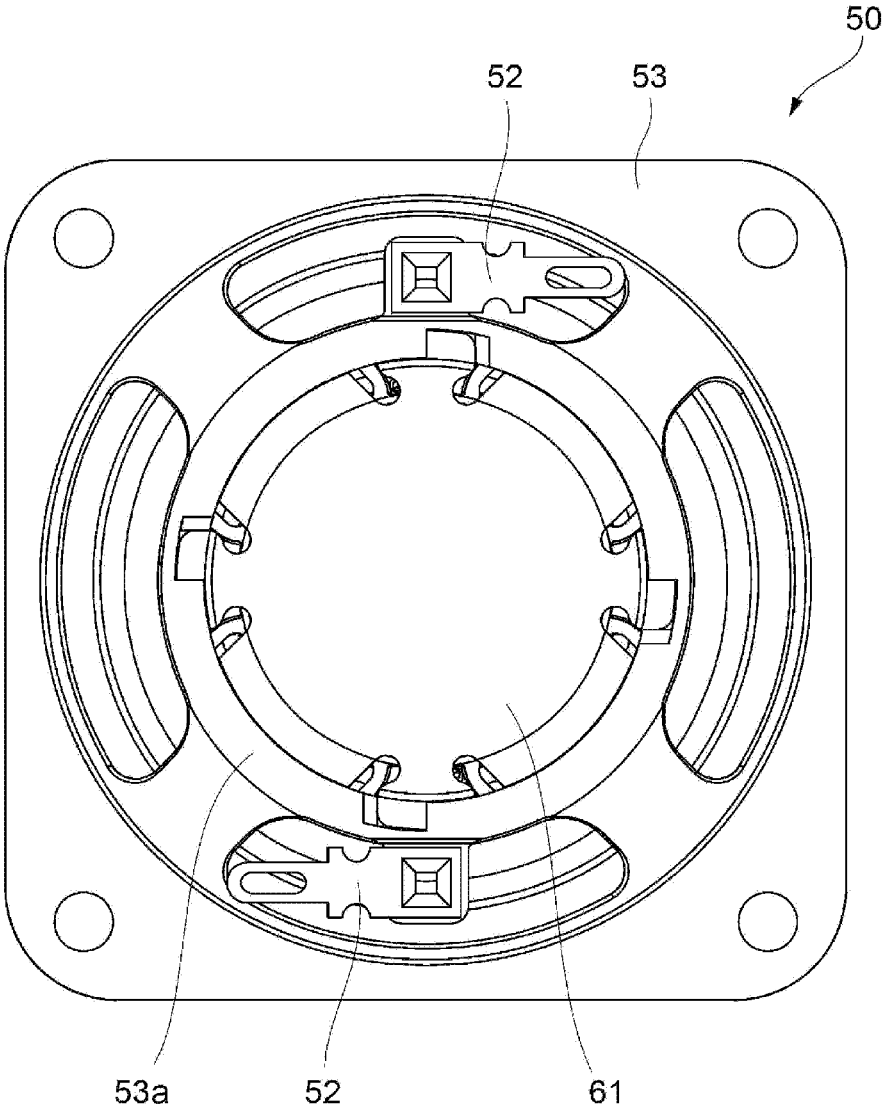
FIG. 3 is a rear view of the assembly shown in FIG. 2.
Figure 4:
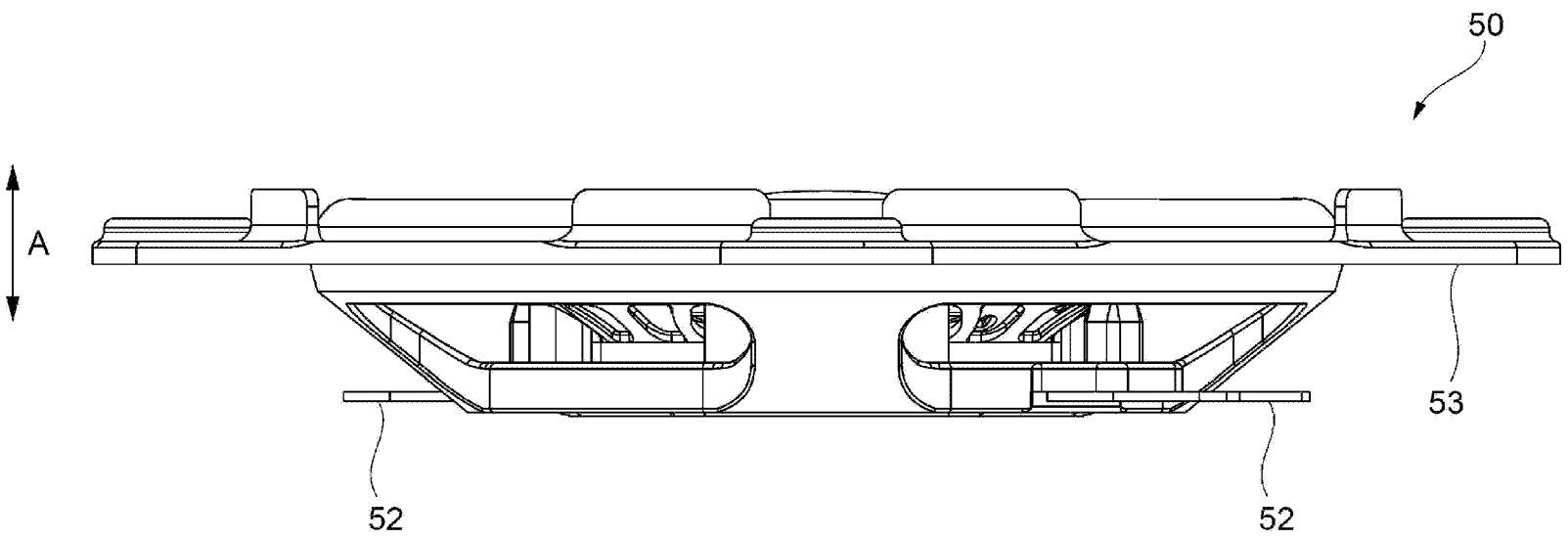
FIG. 4 is a view taken in the direction of arrow IV in FIG. 2.
Figure 5:
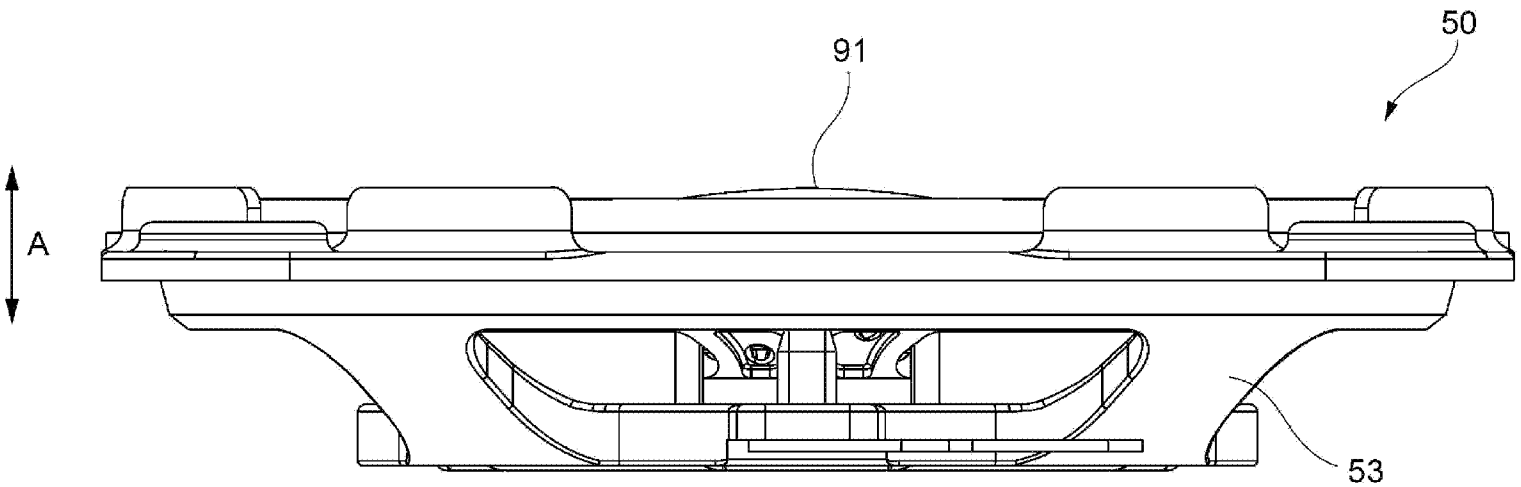
FIG. 5 is a view taken in the direction of arrow V in FIG. 2.
Figure 6:
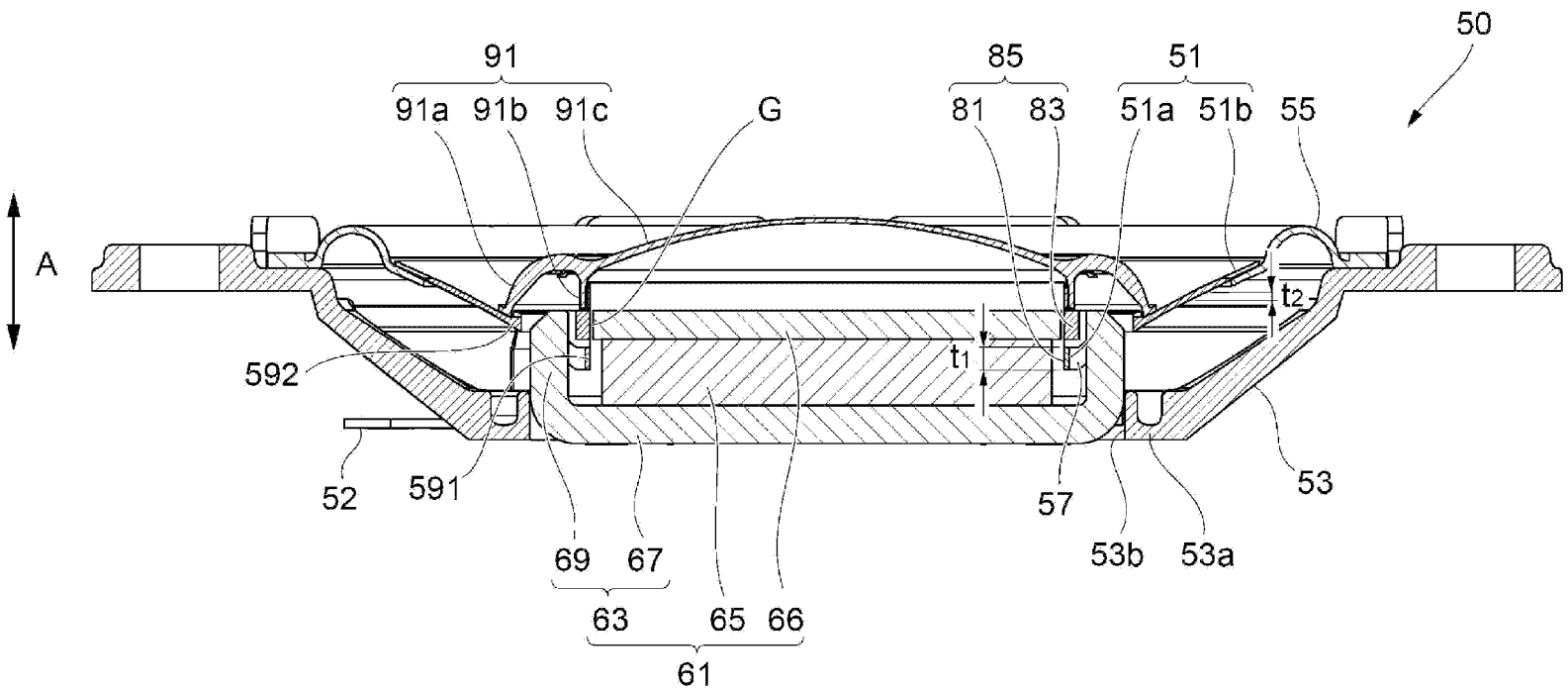
FIG. 6 is a cross-sectional view taken along line VI-VI in FIG. 2.
Figure 7:
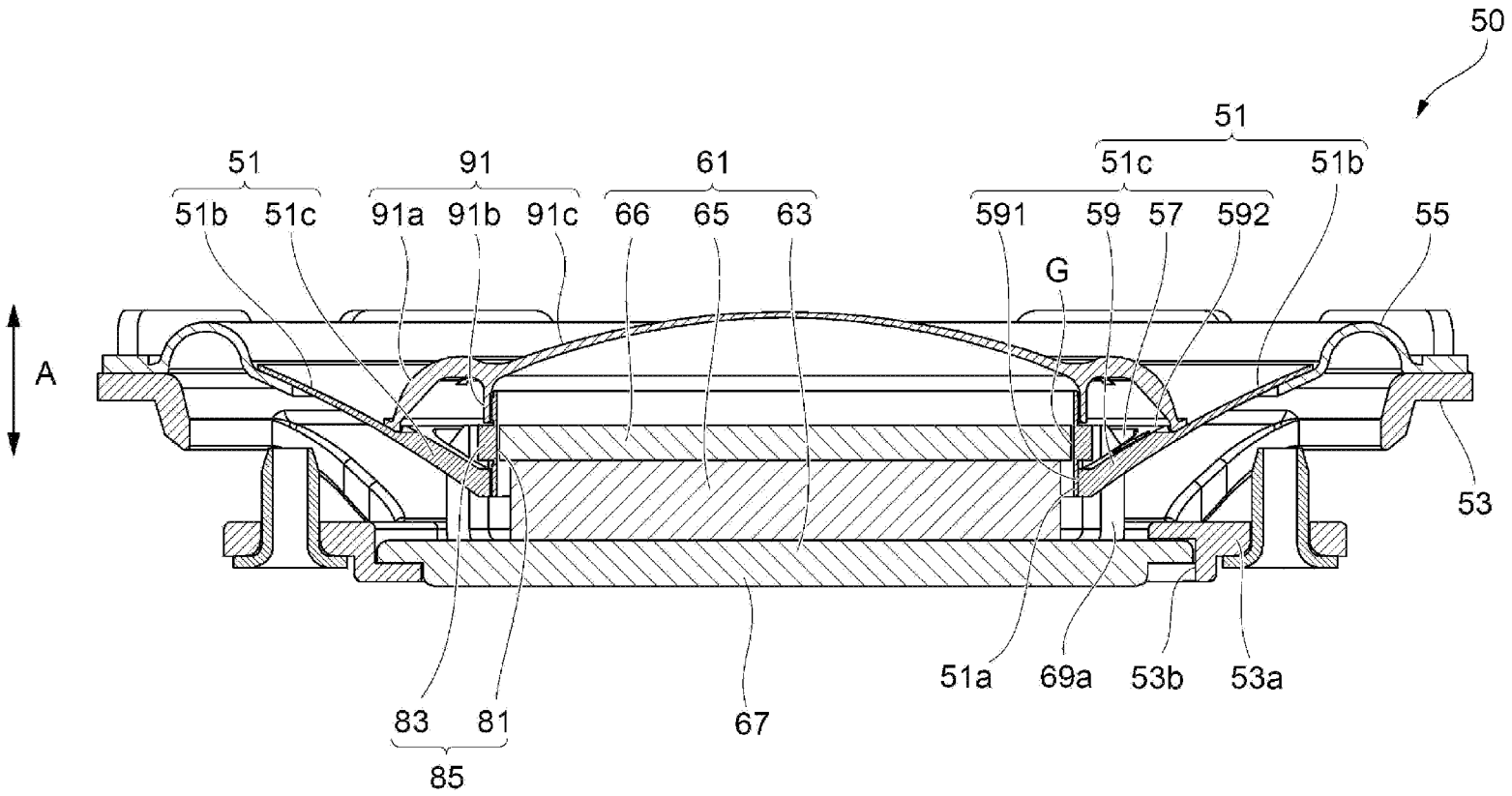
FIG. 7 is a cross-sectional view taken along line VII-VII in FIG. 2.

A first embodiment will be described below. FIG. 1 is an exploded perspective view illustrating a speaker unit according to a first embodiment of the present invention. FIG. 2 is a front view illustrating the components shown in FIG. 1 in an assembled state. FIG. 3 is a rear view of the assembly of FIG. 2. FIG. 4 is a view taken in a direction of arrow IV of FIG. 2. FIG. 5 is a cross-sectional view taken in a direction of arrow V in FIG. 2. FIG. 6 is a cross-sectional view taken along line VI-VI in FIG. 2. FIG. 7 is a cross-sectional view taken along line VII-VII in FIG. 2.

First, a general configuration of a speaker unit 50 of the present embodiment will be described below.

An outer peripheral portion 51*b* of a diaphragm 51 is attached to a frame 53 via an edge portion 55.

The diaphragm 51 is shaped to be recessed at a center thereof from the outer peripheral portion 51*b* to an inner peripheral portion 51*c*, and has a round center hole 51*a* that penetrates the center (inner peripheral portion 51*c*) of the diaphragm 51 in a thickness direction thereof. The frame 53 is shaped to be recessed in the same direction as the diaphragm 51 is recessed, and has a bottom 53*a* at a center thereof. A hole 53*b* is formed to penetrate the bottom 53*a* in a thickness direction thereof.

A magnetic circuit 61 is provided on the bottom 53*a* of the frame 53. The magnetic circuit 61 includes a yoke 63, a magnet 65, and a pole piece 66.

The yoke 63 is a bottomed cylindrical member made of a soft magnetic material, one of end faces of which is open. The yoke 63 has a base portion 67 mounted in the hole 53*b* at the bottom 53*a* of the frame 53, and a cylindrical portion 69 that extends from a peripheral edge of the base portion 67 in a direction away from the bottom 53*a* of the frame 53 along a vibration direction of the diaphragm 51 (a direction of arrows A in FIGS. 1 and 4 to 7) and functions as an outer cylindrical portion of the magnetic circuit 61 (see FIG. 6). That is, the cylindrical portion 69 is an outer cylindrical portion according to the present invention. The cylindrical portion 69 is provided with a plurality of standing walls 69*c* extending from an end of the open end face of the cylindrical portion 69 to the base portion 67 along the vibration direction of the diaphragm 51 (the direction of arrows A), and a plurality of slits 69*a*.

The slits 69*a* of the present embodiment includes four slits 69*a* arranged at a pitch of 90° along a circumferential direction of the cylindrical portion 69. Thus, the cylindrical portion 69 includes the four slits 69*a* and four standing walls 69*c* divided by the four slits 69*a*. In addition, the base portion 67 is provided with four mounting portions 67*a* extending outward to correspond to the slits 69*a*. The four mounting portions 67*a* are fitted into four mounting recesses 53*c* formed in the periphery of the hole 53*b* of the frame 53, thereby positioning the magnetic circuit 61 with respect to the frame 53.

The magnet 65 is formed in a disc shape, and placed on the base portion 67 of the yoke 63. The magnet 65 is magnetized in the vibration direction of the diaphragm 51 (the direction of arrows A). A disc-shaped pole piece 66 made of a soft magnetic material is placed on the magnet 65. Thus, an annular space is formed between an inner peripheral surface of the cylindrical portion 69 of the yoke 63 and an outer peripheral surface of the pole piece 66. This annular space serves as a magnetic gap G in which a substantially uniform magnetic field is generated in the circumferential direction.

The inner peripheral portion 51*c* of the diaphragm 51 is provided with four insert holes 57 in each of which an associated one of the standing walls 69*c* of the yoke 63 of the magnetic circuit 61 is inserted, and four insert portions 59 each of which is inserted into an associated one of the slits 69*a* of the yoke 63 of the magnetic circuit 61. The insert holes 57 and the insert portions 59 are alternately arranged in the circumferential direction. The insert holes 57 penetrate the diaphragm 51 in the vibration direction (thickness direction). Each insert hole 57 serves as a standing wall receiving portion of the present invention. The inner peripheral portion 51*c* of the diaphragm 51 includes a ring-shaped inner annular portion 591 formed inward of the insert holes 57 in a radial direction of the diaphragm 51, and a ring-shaped outer annular portion 592 formed outward of the insert holes 57 in the radial direction of the diaphragm 51. Accordingly, the insert holes 57 are formed between the inner annular portion 591 and the outer annular portion 592. In this embodiment, the center hole 51*a* of the diaphragm 51 is formed by an inner peripheral surface of the inner annular portion 591 (an inner peripheral surface of the inner peripheral portion 51*c*). The inner peripheral surface of the inner annular portion 591 is connected to a voice coil 85.

Although not shown in the drawings, the insert hole 57 of the diaphragm 51 serving as the standing wall receiving portion of the diaphragm 51 may be replaced with a notch formed to open in an inner peripheral surface of the center hole 51*a* of the diaphragm 51. In this case, an inner peripheral surface of each insert portion 59 may be connected to the voice coil 85 without forming the inner annular portion 591.

The voice coil 85 includes a cylindrical bobbin 81 arranged between an inner peripheral surface of the cylindrical portion 69 (the standing walls 69*c*) of the yoke 63 and outer peripheral surfaces of the magnet 65 and the pole piece 66, and a coil 83 wound around an outer peripheral surface of the bobbin 81. The bobbin 81 and the inner peripheral surface of the center hole 51*a* of the diaphragm 51 (the inner peripheral surface of the inner peripheral portion 51*c* of the diaphragm 51) are connected to each other so that the coil 83 is positioned in the magnetic gap G of the magnetic circuit 61. That is, the inner peripheral surface of the inner peripheral portion 51*c* of the diaphragm 51 (the inner peripheral surface of the inner annular portion 591) is connected to the voice coil 85 via the slits 69*a* of the yoke 63 of the magnetic circuit 61.

Suppose that, of the vibration direction of the diaphragm 51 (the directions of arrows A), a direction in which the diaphragm 51 moves away from the magnetic circuit 61 (the base portion 67 of the yoke 63) is regarded as an upward direction, and a direction in which the diaphragm 51 approaches the magnetic circuit 61 is regarded as a downward direction, the inner peripheral surface of the center hole 51*a* of the diaphragm 51 (the inner peripheral surface of the inner peripheral portion 51*c* of the diaphragm 51) is connected to a lower portion of the bobbin 81. More specifically, the inner peripheral surface of the center hole 51*a* of the diaphragm 51 (the inner peripheral surface of the inner peripheral portion 51*c* of the diaphragm 51) is connected to an outer peripheral surface of the bobbin 81 near the base portion 67 of the yoke 63, i.e., the outer peripheral surface of the bobbin 81 below the coil 83.

As shown in FIG. 7, the outer and inner peripheral portions 51*b* and 51*c* of the diaphragm 51 are integrated with each other. The inner peripheral portion 51*c* of the diaphragm 51 is greater in thickness (thicker) than the outer peripheral portion 51*b*.

The inner peripheral portion 51*c* of the diaphragm 51 is shaped to gradually decrease in diameter toward the lower side in the vibration direction (the direction of arrows A), and the inner annular portion 591 is arranged below the outer annular portion 592 in the vibration direction (the direction of arrows A) in the inner peripheral portion 51*c* of the diaphragm 51.

Further, as shown in FIG. 6, in the vibration direction of the diaphragm 51 (the direction of arrows A), the surface of the diaphragm 51 and the surface of the bobbin 81 bonded to each other has a dimension (t1) which is larger than (thicker than) the thickness (t2) of the outer peripheral portion 51*b*.

A dust cap 91 constituting part of the diaphragm 51 is used to keep dust or the like from entering the speaker unit from the center hole 51*a* of the diaphragm 51. As shown in FIGS. 6 and 7, the dust cap 91 includes a dome portion 91*c* which is in the shape of a dome that covers the opening of the bobbin 81, a diaphragm connecting portion 91*a* which is connected to the diaphragm 51, and a voice coil connecting portion 91*b* which is connected to the voice coil 85. The diaphragm connecting portion 91*a* is an outermost peripheral portion of the dust cap 91, and covers the inner peripheral portion 51*c* of the diaphragm 51 from above. The voice coil connecting portion 91*b* is a portion formed radially inward of the diaphragm connecting portion 91*a*.

In FIG. 6, the voice coil connecting portion 91*b* of the dust cap 91 is connected to the outer peripheral surface of the bobbin 81 (an upper portion of the bobbin 81) located above the coil 83 of the voice coil 85. On the other hand, an outer peripheral edge of the diaphragm connecting portion 91*a* of the dust cap 91 is connected to an outer periphery of the inner peripheral portion 51*c* near the boundary between the inner and outer peripheral portions 51*c* and 51*b* of the diaphragm 51. As described above, the inner peripheral surface of the center hole 51*a* of the diaphragm 51 (the inner peripheral surface of the inner annular portion 591) is connected to the outer peripheral surface of the bobbin 81 below the coil 83. In this manner, the inner peripheral surface of the inner peripheral portion 51*c* of the diaphragm 51 is connected to the lower portion of the bobbin 81; the outer periphery of the inner peripheral portion 51*c* is connected to the outer peripheral edge of the diaphragm connecting portion 91*a* of the dust cap 91; and the voice coil connecting portion 91*b* of the dust cap 91 is connected to the upper portion of the bobbin 81. With the diaphragm connecting portion 91*a* covering the inner peripheral portion 51*c* of the diaphragm 51 from above, an inner space surrounded by the inner peripheral portion 51*c* of the diaphragm 51, the diaphragm connecting portion 91*a* of the dust cap 91, and the voice coil 85 is formed inside the diaphragm connecting portion 91*a*.

Referring to FIG. 3, the frame 53 is provided with a terminal 52. The terminal 52 and the coil 83 of the voice coil 85 are electrically connected to each other by a tinsel wire (lead wire) which is not shown.

Next, the operation of the speaker unit 50 configured as described above will be described below. An electric signal inputted to the terminal 52 flows through the coil 83 of the voice coil 85 via the tinsel wire. The coil 83 is arranged in the magnetic field generated by the magnetic circuit 61. Thus, the diaphragm 51 is driven by the driving force generated in the coil 83 (the voice coil 85) and vibrates in the directions of arrows A, and sound is emitted.

According to the configuration described above, the following advantages can be obtained.

(1) The diaphragm 51 includes the insert holes 57 in each of which an associated one of the standing walls 69*c* of the cylindrical portion 69 of the magnetic circuit 61 is inserted, and the insert portions 59 each of which is inserted in an associated one of the slits 69*a* of the cylindrical portion 69. This allows the surface of the diaphragm 51 and the surface of the voice coil 85 to be bonded to each other below the tip end of the magnetic circuit 61 (the tip end of the yoke 63). Therefore, the speaker unit 50 can be thinned down without reducing the height of the diaphragm 51 in the vibration direction. Further, the conical shape of the diaphragm 51 can reliably have a sufficient height difference, which can keep the rigidity of the entire diaphragm 51 from decreasing.

(2) Connecting the inner peripheral surface of the center hole 51*a* of the diaphragm 51 (the inner peripheral surface of the inner peripheral portion 51*c* of the diaphragm 51) to the lower portion of the voice coil 85 (a portion near the base portion 67 of the yoke 63) makes it possible to reliably reduce the thickness of the speaker unit 50 without reducing the height of the diaphragm 51 in the vibration direction.

(3) The double ring, which has been required for thinning the speaker unit, is no longer necessary. This can reduce the number of parts, and the cost as well.

(4) What is driven to vibrate by the voice coil 85 is only the diaphragm 51. Thus, the mass is reduced, and a strong magnetic circuit is no longer necessary, thereby reducing the cost.

(5) Reduced mass of the vibrating portion improves the response of the diaphragm 51 and the sound quality as well.

(6) The dust cap 91 has the diaphragm connecting portion 91*a* connected to the diaphragm 51 and the voice coil connecting portion 91*b* connected to the voice coil 85. This increases the rigidity of the diaphragm 51. Therefore, a speed at which sound is propagated in the diaphragm 51 increases, which can improve the reaction (transient characteristic), and can reproduce delicate and fine sound.

(7) The inner and outer peripheral portions 51*c* and 51*b* of the diaphragm 51 integrated together can increase the rigidity of the diaphragm 51.

(8) The inner peripheral portion 51*c* of the diaphragm 51 which is made thicker than the outer peripheral portion 51*b* of the diaphragm 51 can increase the rigidity of the inner peripheral portion 51*c* of the diaphragm 51, and can keep the mass of the diaphragm 51 from increasing.

(9) The surface of the inner peripheral portion 51*c* of the diaphragm 51 and the surface of the bobbin 81 bonded to each other has the dimension (t1) in the vibration direction larger than the thickness (t2) of the outer peripheral portion 51*b* of the diaphragm 51. This can increase the bonding area between the bobbin 81 and the diaphragm 51, and can improve the durability of the speaker unit 50.

(10) Connecting the inner annular portion 591 of the diaphragm 51 to the lower portion of the voice coil 85, the voice coil connecting portion 91*b* of the dust cap 91 to the upper portion of the voice coil 85, and the diaphragm connecting portion 91*a* of the dust cap 91 to the vicinity of the outer annular portion 592 of the diaphragm 51 can keep the rigidity of the diaphragm 51 from decreasing, and can maintain the conical shape of the diaphragm 51, even if the insert holes 57 are formed in the inner peripheral portion 51*c* of the diaphragm 51.

Second Embodiment

The first embodiment has been directed to the speaker unit 50 having no damper for supporting the voice coil. However, as shown in FIGS. 8 and 9, the speaker unit may further include a damper for supporting the voice coil.

Figure 8:
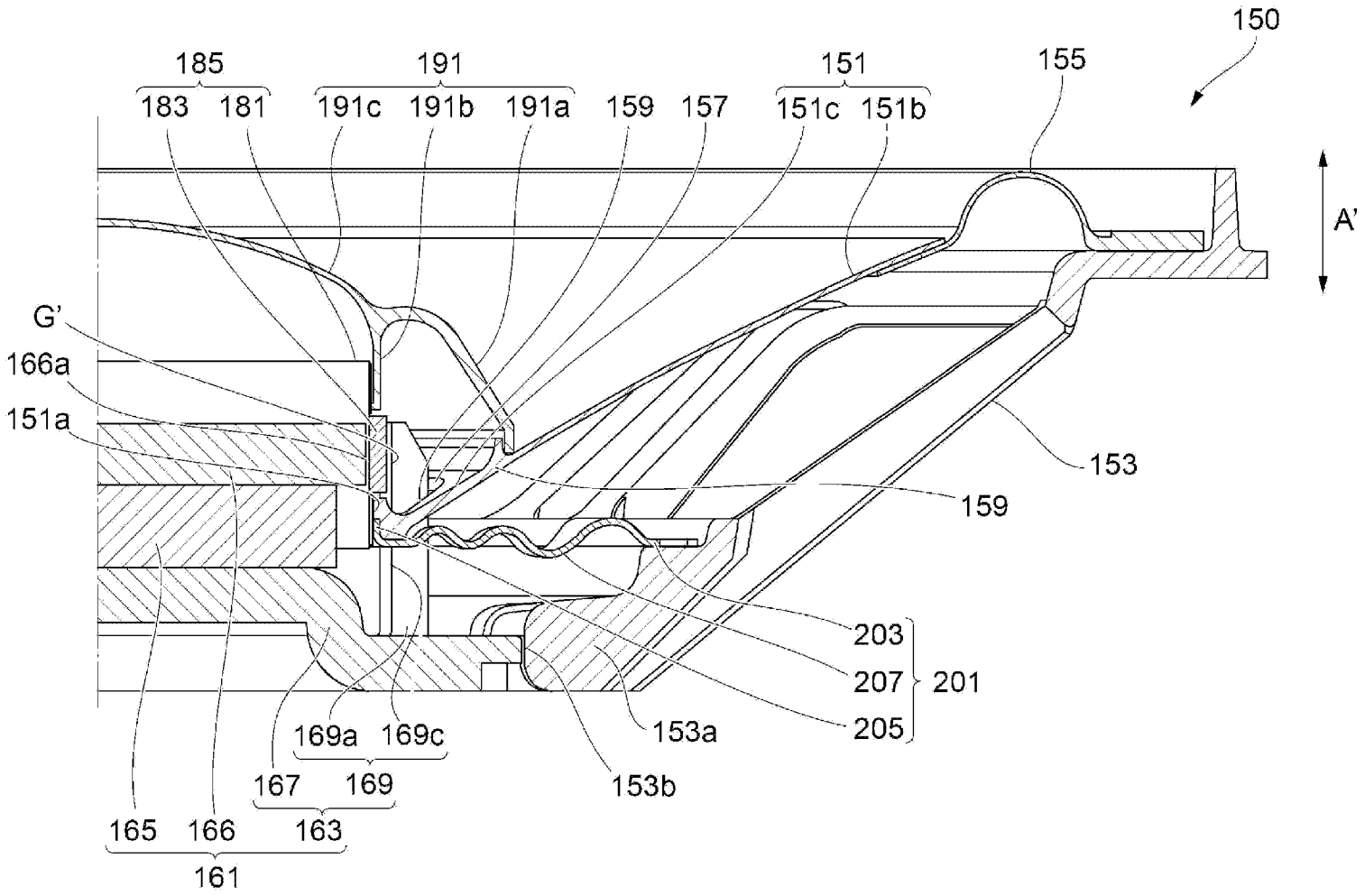
FIG. 8 is a half cross-sectional view of a speaker unit according to a second embodiment of the present invention.
Figure 9:
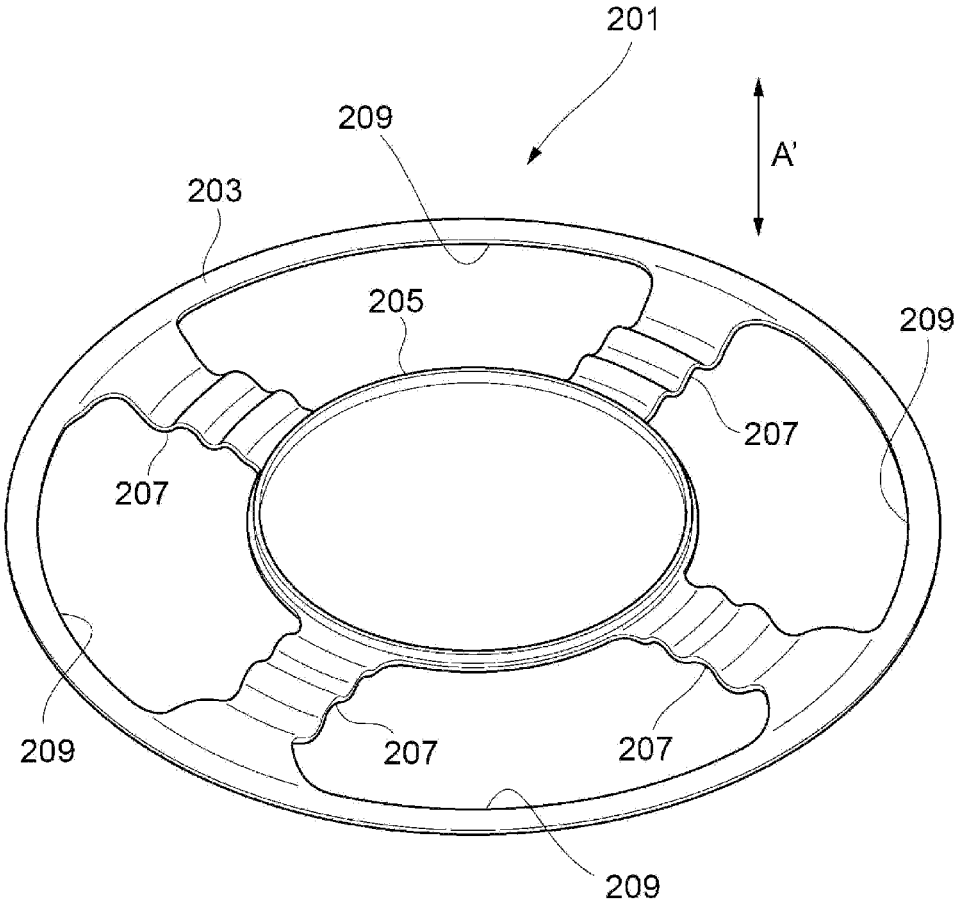
FIG. 9 is a perspective view of a damper shown in FIG. 8.
Figure 10:
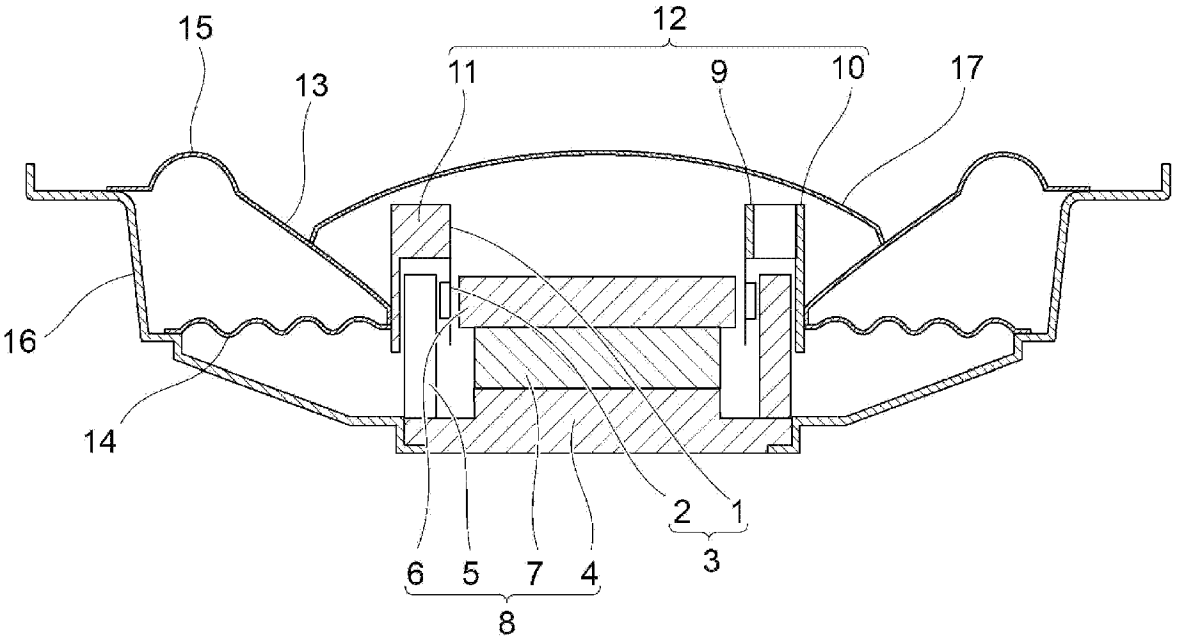
FIG. 10 is a cross-sectional view of a speaker unit taken along line B-O-C in FIG. 11.
Figure 11:
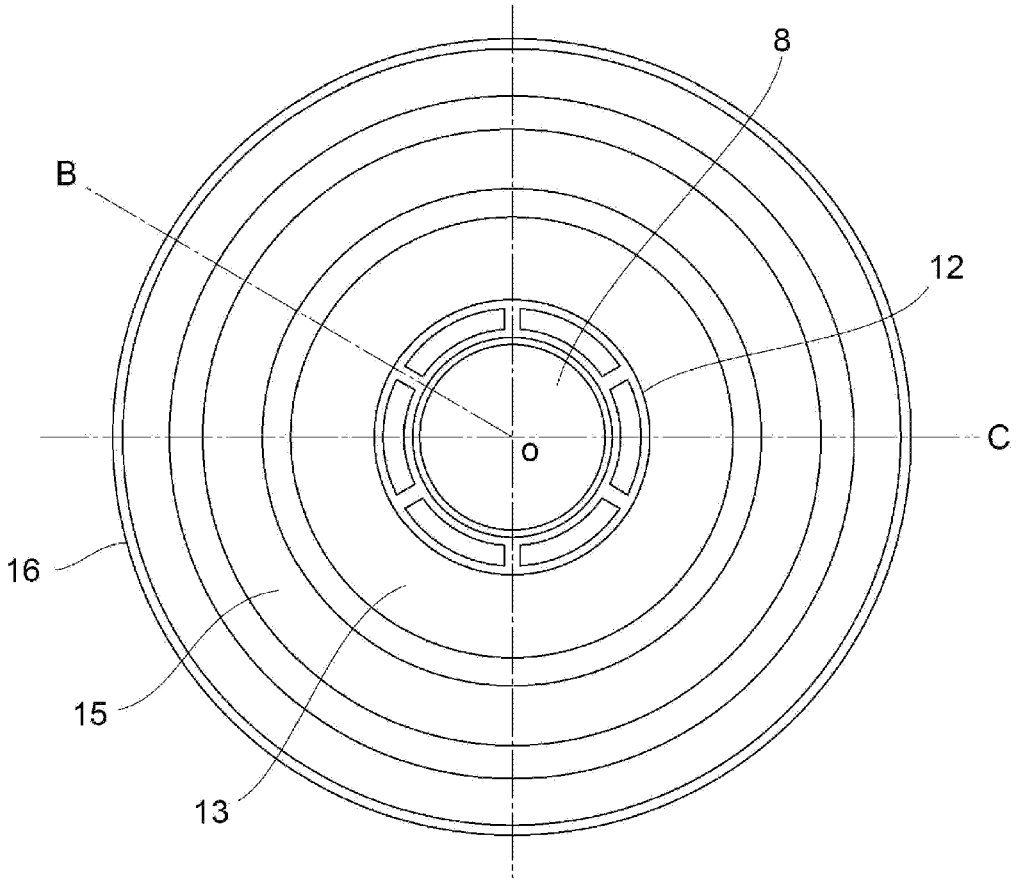
FIG. 11 is a top view of the speaker unit of FIG. 10 from which a dust cap is removed.

FIG. 8 is a half cross-sectional view of a speaker unit 150 according to a second embodiment of the present invention, and FIG. 9 is a perspective view illustrating a damper 201 shown in FIG. 8.

First, a general configuration of the speaker unit 150 of the present embodiment will be described below.

An outer peripheral portion 151*b* of a diaphragm 151 is attached to a frame 153 via an edge portion 155. The diaphragm 151 is shaped to be recessed at a center thereof from the outer peripheral portion 151*b* to an inner peripheral portion 151*c*, and has a round center hole 151*a* that penetrates the center (inner peripheral portion 151*c*) of the diaphragm 151 in a thickness direction thereof.

The frame 153 is shaped to be recessed in the same direction as the diaphragm 151 is recessed, and has a bottom 153*a* at a center thereof. A hole 153*b* is formed to penetrate the bottom 153*a* in a thickness direction thereof. A magnetic circuit 161 is provided on the bottom 153*a* of the frame 153. The magnetic circuit 161 includes a yoke 163, a magnet 165, and a pole piece 166.

The yoke 163 is a bottomed cylindrical member made of a soft magnetic material, one of end faces of which is open. The yoke 163 has a base portion 167 mounted in the hole 153*b* at the bottom 153*a* of the frame 153, and a cylindrical portion 169 that extends from a peripheral edge of the base portion 167 in a direction away from the bottom 153*a* of the frame 153 along a vibration direction of the diaphragm 151 (a direction of arrows A' in FIG. 8) and functions as an outer cylindrical portion of the magnetic circuit 161. That is, the cylindrical portion 169 is an outer cylindrical portion according to the present invention. The cylindrical portion 169 is provided with a plurality of standing walls 169*c* extending from an end of the open end face of the cylindrical portion 169 to the base portion 167 along the vibration direction of the diaphragm 151 (the direction of arrows A'), and a plurality of slits 169*a*.

The slits 169*a* of the present embodiment includes four slits 169*a* arranged at a pitch of 90° along a circumferential direction of the cylindrical portion 169. Thus, the cylindrical portion 169 includes four slits 169*a* and four standing walls 169*c* divided by the four slits 169*a*.

The magnet 165 is formed in a disc shape, and placed on the base portion 167 of the yoke 163. The magnet 165 is magnetized in the vibration direction of the diaphragm 151 (the direction of arrows A'). A disc-shaped pole piece 166 made of a soft magnetic material is placed on the magnet 165. Thus, an annular space is formed between an inner peripheral surface of the cylindrical portion 169 of the yoke 163 and an outer peripheral surface of the pole piece 166. This annular space serves as a magnetic gap G' in which a substantially uniform magnetic field is generated in the circumferential direction.

The diaphragm 151 has the same shape as the diaphragm 51 of the first embodiment. The inner peripheral portion 151*c* of the diaphragm 151 and is provided with four insert holes (standing wall receiving portions) 157 in each of which an associated one of the standing walls 169*c* of the yoke 163 of the magnetic circuit 161 is inserted, and four insert portions 159 each of which is inserted in an associated one of the slits 169*a* of the yoke 163 of the magnetic circuit 161. The insert holes 157 and the insert portions 159 are alternately arranged in the circumferential direction. The insert holes 157 penetrate the diaphragm 151 in the vibration direction (thickness direction).

A voice coil 185 includes a cylindrical bobbin 181 arranged between an inner peripheral surface of the cylindrical portion 169 (the standing walls 169*c*) of the yoke 163 and outer peripheral surfaces of the magnet 165 and the pole piece 166, and a coil 183 wound around an outer peripheral surface of the bobbin 181. The bobbin 181 and the inner peripheral surface of the center hole 151*a* of the diaphragm 151 (the inner peripheral surface of the inner peripheral portion 151*c* of the diaphragm 151) are connected to each other so that the coil 183 is positioned in the magnetic gap G' of the magnetic circuit 161. That is, the inner peripheral surface of the inner peripheral portion 151*c* of the diaphragm 151 is connected to the voice coil 185 via the slits 169*a* of the yoke 163 of the magnetic circuit 161.

Suppose that, of the vibration direction of the diaphragm 151 (in the directions of arrows A'), a direction in which the diaphragm 151 moves away from the magnetic circuit 161 (the base portion 167 of the yoke 163) is regarded as an upward direction, and a direction in which the diaphragm 151 approaches the magnetic circuit 161 is regarded as a downward direction, the inner peripheral surface of the center hole 151*a* of the diaphragm 151 (the inner peripheral surface of the inner peripheral portion 151*c* of the diaphragm 151) is connected to a lower portion of the bobbin 181. More specifically, the inner peripheral surface of the center hole 151*a* of the diaphragm 151 (the inner peripheral surface of the inner peripheral portion 151*c* of the diaphragm 151) is connected to an outer peripheral surface of the bobbin 181 near the base portion 167 of the yoke 163, i.e., the outer peripheral surface of the bobbin 181 below the coil 183.

The outer and inner peripheral portions 151*b* and 151*c* of the diaphragm 151 are integrated with each other. The inner peripheral portion 151*c* of the diaphragm 151 is greater in thickness (thicker) than the outer peripheral portion 151*b*.

A dust cap 191 constituting part of the diaphragm 151 is used to keep dust or the like from entering the speaker unit from center hole 151*a* of the diaphragm 151. The dust cap 191 includes a dome portion 191*c* which is in the shape of a dome that covers the opening of the bobbin 181, a diaphragm connecting portion 191*a* which is connected to the diaphragm 151, and a voice coil connecting portion 191*b* which is connected to the voice coil 185. The diaphragm connecting portion 191*a* is an outermost peripheral portion of the dust cap 191, and covers the inner peripheral portion 151*c* of the diaphragm 151 from above. The voice coil connecting portion 191*b* is a portion formed radially inward of the diaphragm connecting portion 191*a*.

The voice coil connecting portion 191*b* of the dust cap 191 is connected to the outer peripheral surface of the bobbin 181 (an upper portion of the bobbin 181) located above the coil 183 of the voice coil 185. On the other hand, an outer peripheral edge of the diaphragm connecting portion 191*a* of the dust cap 191 is connected to an outer periphery of the inner peripheral portion 151*c* near the boundary between the inner and outer peripheral portions 151*c* and 151*b* of the diaphragm 151. As described above, the inner peripheral surface of the center hole 151*a* of the diaphragm 151 is connected to the outer peripheral surface of the bobbin 181 below the coil 183. In this manner, the inner peripheral surface of the inner peripheral portion 151*c* of the diaphragm 151 is connected to the lower portion of the bobbin 181; the outer periphery of the inner peripheral portion 151*c* is connected to the outer peripheral edge of the diaphragm connecting portion 191*a* of the dust cap 191; and the voice coil connecting portion 191*b* of the dust cap 191 is connected to the upper portion of the bobbin 181. With the diaphragm connecting portion 191*a* covering the inner peripheral portion 151*c* of the diaphragm 151 from above, an inner space surrounded by the inner peripheral portion 151*c* of the diaphragm 151, the diaphragm connecting portion 191*a* of the dust cap 191, and the voice coil 185 is formed inside the diaphragm connecting portion 191*a*.

In this embodiment, a damper 201 supports the voice coil 185. As shown in FIG. 9, the damper 201 includes an outer ring portion 203 connected to the frame 153, an inner ring portion 205 connected to the voice coil 185, bridge portions 207 that bridge over the outer ring portion 203 and the inner ring portion 205, and openings 209 each of which is surrounded by the outer ring portion 203, the inner ring portion 205, and the bridge portions 207. The outer ring portion 203 and the inner ring portion 205 are concentrically formed, and the inner ring portion 205 is arranged inside the outer ring portion 203.

The outer ring portion 203 is connected to a lower portion of the frame 153, i.e., connected to the frame 153 below the edge portion 155. The inner ring portion 205 is connected to a portion of the bobbin 181 of the voice coil 185 below a junction between the bobbin 181 and the diaphragm 151. Each bridge portion 207 extends in a radial direction of the outer ring portion 203, and bridges over the outer ring portion 203 and the inner ring portion 205. In FIG. 9, the damper 201 has four bridge portions 207. The openings 209 penetrate the diaphragm 151 in the vibration direction (the thickness direction of the damper 201), and include four openings 209, equal to the number of bridge portions 207. The number of bridge portions 207 and openings 209 is not limited to four, and may be any other number.

Each bridge portion 207 is inserted into an associated one of the slits 169*a* of the yoke 163 of the magnetic circuit 161. The bridge portion 207 is corrugated when viewed in section taken along the radial direction. When the bridge portion 207 warps in the vibration direction of the diaphragm 151 (the direction of the arrows A'), the voice coil 185 supported by the damper 201 can move in the direction of arrows A'. In each of the openings 209, an associated one of the standing walls 169*c* of the yoke 163 of the magnetic circuit 161 is inserted.

Next, the operation of the speaker unit 150 configured as described above will be described below. An electric signal flows through the coil 183 of the voice coil 185. The coil 183 is arranged in the magnetic field generated by the magnetic circuit 161. Thus, the diaphragm 151 is driven by the driving force generated in the coil 183 (the voice coil 185) and vibrates in the direction of arrows A', and sound is emitted.

According to the configuration described above, the following advantages can be obtained.

(1) The diaphragm 151 includes the insert holes 157 in each of which an associated one of the standing walls 169*c* of the cylindrical portion 169 of the magnetic circuit 161 is inserted, and the insert portions 159 each of which is inserted in an associated one of the slits 169*a* of the cylindrical portion 169. This allows the surface of the diaphragm 151 and the surface of the voice coil 185 to be bonded to each other below the tip end of the magnetic circuit 161 (the yoke 163). Therefore, the speaker unit 150 can be thinned down without reducing the height of the diaphragm 151 in the vibration direction. Further, the conical shape of the diaphragm 151 can reliably have a sufficient height difference, which can keep the rigidity of the entire diaphragm 151 from decreasing.

(2) Connecting the inner peripheral surface of the center hole 151*a* of the diaphragm 151 (the inner peripheral surface of the inner peripheral portion 151*c* of the diaphragm 151) to the lower portion of the voice coil 185 (a portion near the base portion 167 of the yoke 163) makes it possible to reliably reduce the thickness of the speaker unit 150 without reducing the height of the diaphragm 151 in the vibration direction.

(3) The double ring, which has been required for thinning the speaker unit, is no longer necessary. This can reduce the number of parts, and the cost as well.

(4) What is driven to vibrate by the voice coil 185 is only the diaphragm 151. Thus, the mass is reduced, and a strong magnetic circuit is no longer necessary, thereby reducing the cost.

(5) Reduced mass of the vibrating portion improves the response of the diaphragm 151, and the sound quality as well.

(6) The dust cap 191 has the diaphragm connecting portion 191*a* connected to the diaphragm 151 and the voice coil connecting portion 191*b* connected to the voice coil 185. This increases the rigidity of the diaphragm 151. Therefore, a speed at which sound is propagated in the diaphragm 151 increases, which can improve the reaction (transient characteristic), and can reproduce delicate and fine sound.

(7) The inner and outer peripheral portions 151*c* and 151*b* of the diaphragm 151 integrated together can increase the rigidity of the diaphragm 151.

(8) The inner peripheral portion 151*c* of the diaphragm 151 which is made thicker than the outer peripheral portion 151*b* of the diaphragm 151 can increase the rigidity of the inner peripheral portion 151*c* of the diaphragm 151, and can keep the mass of the diaphragm 151 from increasing.

(9) Providing the damper 201 for supporting the voice coil 185 makes it possible to support the voice coil 185 on the frame 153 not only via the edge portion 155 and the diaphragm 151, but also via the damper 201. Thus, the edge portion 155, the diaphragm 151, and the damper 201 can stably support the voice coil 185 while allowing the voice coil 185 to vibrate in the vibration direction. In addition, since the diaphragm 151 is large in diameter, the voice coil 185, if increased in size, can be stably supported by the damper 201. This can improve the sound quality.

DESCRIPTION OF REFERENCE CHARACTERS

50, 150 Speaker Unit
51, 151 Diaphragm
51*a*, 151*a* Center Hole
51*b*, 151*b* Outer Peripheral Portion
51*c*, 151*c* Inner Peripheral Portion
53, 153 Frame
57, 157 Insert Hole (Standing Wall Receiving Portion)
59, 159 Insert Portion
61, 161 Magnetic Circuit
69, 169 Cylindrical Portion (Outer Cylindrical Portion)
69*a*, 169*a* Slit
69*c*, 169*c* Standing Wall
85, 185 Voice Coil
A, A' Vibration Direction of Diaphragm
G, G' Magnetic Gap

The invention claimed is:

1. A speaker unit, comprising:

a magnetic circuit having an outer cylindrical portion and an annular space formed inside the outer cylindrical portion, the annular space serving as a magnetic gap;

a voice coil including a cylindrical bobbin arranged in the magnetic gap, and a coil; and a diaphragm having a center hole that penetrates a center of the diaphragm, an outer peripheral portion supported on a frame, and an inner peripheral portion whose inner peripheral surface is connected to the voice coil, wherein the outer cylindrical portion of the magnetic circuit includes a standing wall formed along a vibration direction of the diaphragm, and a slit, the inner peripheral portion of the diaphragm is integrated with the diaphragm and includes a standing wall receiving portion in which the standing wall is inserted, and an insert portion which is inserted in the slit, and suppose that, of the vibration direction of the diaphragm, a direction in which the diaphragm moves away from the magnetic circuit is regarded as an upward direction, and a direction in which the diaphragm approaches the magnetic circuit is regarded as a downward direction, the inner peripheral surface of the inner peripheral portion of the diaphragm is connected to a lower portion of the voice coil.

2. The speaker unit of claim 1, further comprising a dust cap covering the voice coil, wherein the dust cap is connected to the diaphragm and the voice coil.

3. The speaker unit of claim 2, wherein the dust cap includes a diaphragm connecting portion formed in an outer peripheral portion thereof and connected to the diaphragm, and a voice coil connecting portion formed radially inward of the diaphragm connecting portion and connected to an upper portion of the voice coil.

4. The speaker unit of claim 1, wherein the standing wall receiving portion is an insert hole that penetrates the diaphragm in the vibration direction, the inner peripheral portion of the diaphragm includes an inner annular portion having a ring shape and formed inward of the insert hole in a radial direction of the diaphragm, and an inner peripheral surface of the inner annular portion is connected to the voice coil.

5. The speaker unit of claim 1, wherein the inner peripheral portion and outer peripheral portion of the diaphragm are integrated together.

6. The speaker unit of claim 1, wherein the inner peripheral portion of the diaphragm is thicker than the outer peripheral portion of the diaphragm.

7. The speaker unit of claim 1, wherein a surface of the inner peripheral portion of the diaphragm and a surface of the voice coil bonded to each other has a larger dimension than the outer peripheral portion of the diaphragm in the vibration direction of the diaphragm.

8. The speaker unit of claim 1, further comprising:

a damper having an outer ring portion connected to the frame;

an inner ring portion connected to the voice coil;

a bridge portion that bridges over the outer ring portion and the inner ring portion and is inserted into the slit; and an opening in which the standing wall is inserted.

* * * * *